US009625181B2

(12) United States Patent
Kim et al.

(10) Patent No.: US 9,625,181 B2
(45) Date of Patent: Apr. 18, 2017

(54) REFRIGERATOR CYCLE SYSTEM AND REFRIGERATOR HAVING THE SAME INCLUDING A GAS-LIQUID SEPARATOR AND A LIQUID REFRIGERANT REMOVER

(71) Applicant: LG ELECTRONICS INC., Seoul (KR)

(72) Inventors: Seongjae Kim, Seoul (KR); Myungryul Lee, Seoul (KR); Deokhyun Youn, Seoul (KR); Seunghwan Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 290 days.

(21) Appl. No.: 13/949,071

(22) Filed: Jul. 23, 2013

(65) Prior Publication Data

US 2014/0026610 A1 Jan. 30, 2014

(30) Foreign Application Priority Data

Jul. 24, 2012 (KR) ..... 10-2012-0080499

(51) Int. Cl.
*F25B 1/00* (2006.01)
*F25B 1/10* (2006.01)

(52) U.S. Cl.
CPC ..... *F25B 1/00* (2013.01); *F25B 1/10* (2013.01); *F25B 2400/05* (2013.01);
(Continued)

(58) Field of Classification Search
CPC ..... F25B 1/00; F25B 1/10; F25B 2400/05; F25B 2400/054; F25B 2400/23
(Continued)

(56) References Cited

U.S. PATENT DOCUMENTS 2,724,240 A * 11/1955 Sloan ..... 62/174
3,487,656 A * 1/1970 Grant ..... 62/174
(Continued)

FOREIGN PATENT DOCUMENTS

DE 69003067 T2 4/1994
EP 1729074 A2 12/2006
(Continued)

*Primary Examiner* — Jianying Atkisson
*Assistant Examiner* — David Teitelbaum
(74) *Attorney, Agent, or Firm* — Birch, Stewart, Kolasch & Birch, LLP

(57) ABSTRACT

A refrigerating cycle system and a refrigerator having the same are provided. The refrigerating cycle system includes a condenser, a first capillary tube unit configured to receive refrigerant that has passed through the condensing unit, a gas-liquid separating unit configured to separate the refrigerant that has passed through the first capillary tube unit into liquid refrigerant and gaseous refrigerant, a first evaporator unit configured to receive the liquid refrigerant separated at the gas-liquid separating unit, a liquid refrigerant removal unit configured to receive the gaseous refrigerant separated at the gas-liquid separating unit and a first compressor unit configured to receive the gaseous refrigerant from the liquid refrigerant removal unit. The liquid refrigerant removal unit prevents supplying the separated liquid refrigerant to the first compressor unit.

16 Claims, 19 Drawing Sheets

(52) U.S. Cl.
CPC ..... *F25B 2400/054* (2013.01); *F25B 2400/13* (2013.01); *F25B 2400/23* (2013.01); *F25B 2500/28* (2013.01)

(58) Field of Classification Search
USPC ..... 62/498, 512
See application file for complete search history.

(56) References Cited

U.S. PATENT DOCUMENTS

| | | | | | |
|---|---|---|---|---|---|
| 4,918,942 | A | | 4/1990 | Jaster | |
| 4,966,010 | A | * | 10/1990 | Jaster et al. | 62/179 |
| 5,254,279 | A | * | 10/1993 | Takemasa et al. | 252/67 |
| 5,285,652 | A | * | 2/1994 | Day | 62/199 |
| 8,561,425 | B2 | * | 10/2013 | Mitra et al. | 62/498 |
| 2002/0069654 | A1 | * | 6/2002 | Doi et al. | 62/199 |
| 2006/0266072 | A1 | * | 11/2006 | Takeuchi | F25B 40/00 62/500 |
| 2010/0199707 | A1 | * | 8/2010 | Pearson | 62/434 |

FOREIGN PATENT DOCUMENTS

| | | | |
|---|---|---|---|
| EP | 1795835 | A2 | 6/2007 |
| JP | 2002-181398 | A | 6/2002 |
| JP | 2005-226972 | A | 8/2005 |
| JP | 2005-257149 | A | 9/2005 |

* cited by examiner

REFRIGERATOR CYCLE SYSTEM AND REFRIGERATOR HAVING THE SAME INCLUDING A GAS-LIQUID SEPARATOR AND A LIQUID REFRIGERANT REMOVER

CROSS REFERENCE TO RELATED APPLICATION

Pursuant to 35 U.S.C. §119(a), this application claims the benefit of the Patent Korean Application No. 10-2012-0080499, filed on Jul. 24, 2012, which is hereby incorporated by reference in its entirety.

BACKGROUND OF THE DISCLOSURE

Field of the Disclosure

The present invention relates to a refrigerating cycle system and a refrigerator having the same, and more particularly, to a refrigerating cycle system having improved operation efficiency, and a refrigerator having the same.

Discussion of the Related Art

In general, a refrigerator used for frozen or refrigerated storage of food is provided with a case which includes partitioned spaces for a freezing chamber and a refrigerating chamber. The refrigerator also includes machinery, such as a compressor, a condenser, an evaporator, a capillary tube, and so on for forming the refrigerating cycle system to lower temperatures of the freezing chamber and the refrigerating chamber.

The refrigerator has one or more doors mounted to the case for opening/closing the freezing chamber and the refrigerating chamber.

The refrigerator performs refrigerating operation with a refrigerating cycle system in which low temperature and low pressure gaseous refrigerant is compressed to high temperature and high pressure gaseous refrigerant by the compressor, the high temperature and high pressure compressed gaseous refrigerant is turned to high pressure liquid refrigerant as the high temperature and high pressure compressed gaseous refrigerant passes through the condenser, the high pressure liquid refrigerant experiences a temperature and a pressure drop as the high pressure liquid refrigerant passes through the capillary tube, and the refrigerant having the temperature and pressure dropped cools down air around the evaporator as the refrigerant is turned to low temperature and low pressure gaseous refrigerant while absorbing heat from the air around the evaporator.

Efforts for improving the operation efficiency of the refrigerating cycle system used in the refrigerator are in progress for saving energy.

Particularly, if liquid refrigerant is introduced to the compressor used in the refrigerating cycle system, the operation efficiency of the refrigerating cycle system becomes poor, and, furthermore, a problem in driving the compressor is likely to occur.

SUMMARY OF THE DISCLOSURE

To solve the foregoing problems, an object of the present invention is to provide a refrigerating cycle system which can improve operation efficiency of the refrigerating cycle system for saving energy and a refrigerator having the same.

Another object of the present invention is to provide a refrigerating cycle system in which a flow rate of liquid refrigerant to a compressor can be reduced for preventing problems taking place in operation of the compressor and a refrigerator having the same.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerating cycle system includes a first capillary tube unit for guiding refrigerant passed through a condensing unit thereto, a gas-liquid separating unit for separating the refrigerant passed through the first capillary tube unit into liquid refrigerant and gas refrigerant, a first evaporator unit for guiding the liquid refrigerant separated at the gas-liquid separating unit thereto, a liquid refrigerant removal unit for guiding the gas refrigerant separated at the gas-liquid separating unit thereto, and a first compressor unit for introducing the refrigerant guided to the liquid refrigerant removal unit thereto, wherein the liquid refrigerant removal unit prevents supplying the liquid refrigerant to the first compressor unit.

The liquid refrigerant removal unit can reduce a flow rate of the liquid refrigerant moving together with the gas refrigerant separated at the gas-liquid separating unit.

The liquid refrigerant removal unit can increase a ratio of the gas refrigerant separated at the gas-liquid separating unit.

The liquid refrigerant removal unit can increase a flow rate of the gas refrigerant separated at the gas-liquid separating unit.

The liquid refrigerant removal unit can be arranged to enable heat exchange with the condensing unit.

The liquid refrigerant in the liquid refrigerant removal unit can undergo a phase change to a gas refrigerant upon reception of heat from the condensing unit.

The liquid refrigerant removal unit can be arranged adjacent to the condensing unit.

The liquid refrigerant removal unit can separate the refrigerant separated at the gas-liquid separating unit into the gas refrigerant and the liquid refrigerant.

The gas refrigerant separated at the liquid refrigerant removal unit can be guided to the first compressor unit, and the liquid refrigerant separated at the liquid refrigerant removal unit can be guided to the gas-liquid separating unit.

The gas-liquid separating unit can have a capacity smaller than the capacity of the liquid refrigerant removal unit.

The liquid refrigerant removal unit can buffer a pressure change of the gas refrigerant separated at the gas-liquid separating unit caused by movement of the gas refrigerant.

The refrigerating cycle system can further include a second compressor unit for guiding the refrigerant passed through the first evaporator unit thereto, and the first compressor unit can have the refrigerant passed through the second compressor unit and the refrigerant passed through the liquid refrigerant removal unit guided thereto.

The refrigerating cycle system can further include a second capillary tube unit for passing the liquid refrigerant separated at the gas-liquid separating unit therethrough, and the refrigerant can be guided to the first evaporator unit after passed through the second capillary tube unit.

The refrigerating cycle system can further include a second evaporator unit for guiding the refrigerant passed through the first capillary tube unit thereto, and the refrigerant can be guided to the gas-liquid separating unit after passed through the second evaporator unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention, illustrate embodiments of the invention and together with the description serve to explain the principle of the invention. In the drawings.

DESCRIPTION OF SPECIFIC EMBODIMENTS

Figure 1:
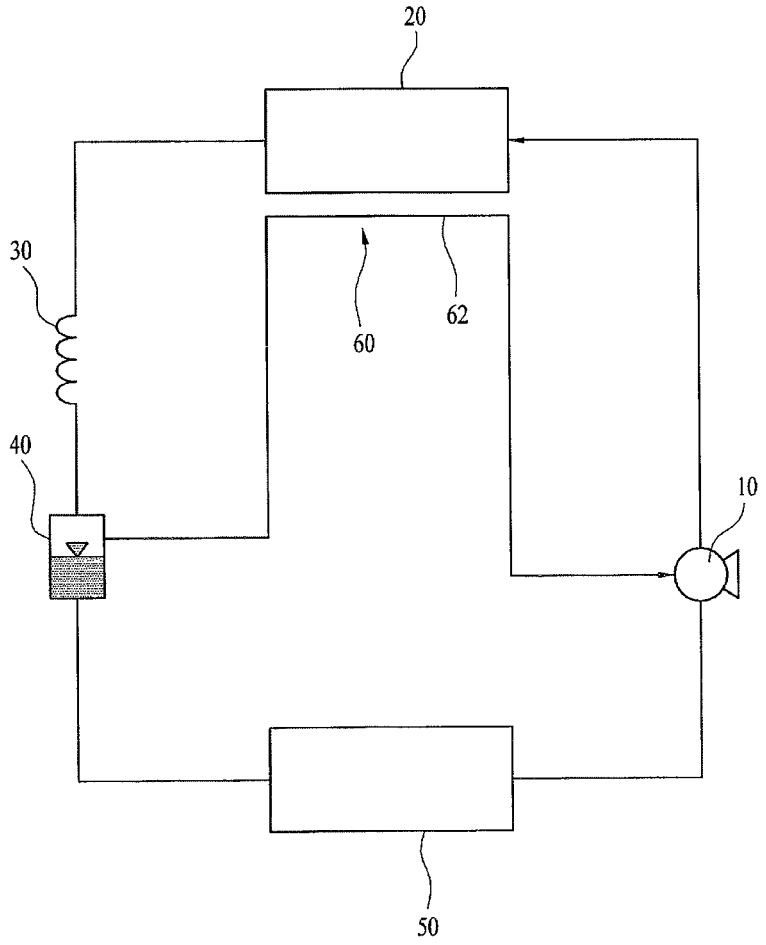
FIG. 1 illustrates a diagram showing a refrigerating cycle system in accordance with a first embodiment of the present invention.

Reference will now be made in detail to the specific embodiments of the present invention, examples of which are illustrated in the accompanying drawings.

For convenience and clarity of description, a size or a shape of an element shown in the drawing may be exaggerated. Terms specially defined taking a configuration and operation of the present invention into account may vary with intentions or usual practices of the user and operator. It is required that definition on such terms is made with reference to entire description of the present invention.

FIG. 1 illustrates a diagram showing a refrigerating cycle system in accordance with a first embodiment of the present invention.

Referring to FIG. 1, the refrigerating cycle system includes a first compressor unit 10 for compressing refrigerant, a condensing unit 20 for introduction of the refrigerant compressed at the first compressor unit 10 thereto, a first capillary tube unit 30 for guiding the refrigerant passed through the condensing unit thereto, and a first evaporator unit 50 for guiding the refrigerant passed through the first capillary tube unit 30 thereto.

A gas-liquid separating unit 40 for separating the refrigerant introduced thereto into liquid refrigerant and gas refrigerant is provided between the first capillary tube unit 30 and the first evaporator unit 50. That is, the refrigerant guided to the gas-liquid separating unit 40 from the first capillary tube unit 30 has the liquid refrigerant thereof moved to the first evaporator 50 and the gas refrigerant thereof moved to the first compressor unit 10 by the gas-liquid separating unit 40.

In general, even if the gas-liquid separating unit 40 mounted between the first capillary tube unit 30 and the first evaporator unit 50 separates the gas refrigerant from the liquid refrigerant, a substantial ratio of the liquid refrigerant moves together with the gas refrigerant. This is because, though the gas-liquid separating unit 40 separates the gas refrigerant from the liquid refrigerant by using characteristics that the liquid refrigerant moves down due to gravity and the gas refrigerant is relatively lighter than the liquid refrigerant, the refrigerant passed through the first capillary tube 30 undergoes an instantaneous pressure rise to cause discharge of the liquid refrigerant to a gas refrigerant outlet.

Of course, it may be possible that capacity of the gas-liquid separating unit 40 is designed to have a large capacity for improving a separating efficiency of the liquid refrigerant from the gas refrigerant. However, an increased capacity of the gas-liquid separating unit 40 not only requires various design changes, but also causes an overall operation efficiency drop due to heat exchange of the refrigerant at the gas-liquid separating unit 40. Therefore, the gas-liquid separating unit 40 has a limitation in enhancing an effect of separating the liquid refrigerant from the gas refrigerant.

Therefore, the refrigerating cycle system of the present invention further includes a liquid refrigerant removal unit 60 for filtering the gas refrigerant separated at the gas-liquid separating unit 40 once more. The liquid refrigerant removal unit 60 can prevent the liquid refrigerant from being supplied to the first compressor unit 10.

Since the liquid refrigerant removal unit 60 can reduce a flow rate of the liquid refrigerant from the gas refrigerant and the liquid refrigerant being supplied to the gas-liquid separating unit 40, the introduction of the liquid refrigerant to the first compressor unit 10 can be prevented.

The reduction of the flow rate of the liquid refrigerant by the liquid refrigerant removal unit 60 allows for increase of a ratio of the gas refrigerant. In other words, the liquid refrigerant removal unit 60 can increase a flow rate of the gas refrigerant.

In the refrigerating cycle system in accordance with the first embodiment of the present invention, the liquid refrigerant removal unit 60 further includes a duct 62 arranged to heat exchange with the condensing unit 20. The duct 62 is arranged adjacent to the condensing unit physically to allow for heat exchange with the refrigerant passing through the condensing unit 20.

The condensing unit 20 maintains a relatively high temperature because the condensing unit 20 has high temperature refrigerant compressed at the first compressor unit 10 passing therethrough. Therefore, as the condensing unit 20 heat exchanges with the duct 62, the condensing unit 20 can supply heat to the liquid refrigerant in the duct 62, allowing the liquid refrigerant in the duct 62 to have a phase change to the gas refrigerant owing to the heat.

According to this, the flow rate of the liquid refrigerant in the duct 62 decreases, while the flow rate of the gas refrigerant in the duct 62 increases, to increase the ratio of the gas refrigerant.

Since the liquid refrigerant removal unit 60 can reduce the flow rate of the liquid refrigerant introduced thereto unintentionally, introduction of the liquid refrigerant to the first compressor unit 10, which causes overloading of the first compressor unit 10, can be prevented.

The duct 62 may have a plurality of fins provided thereto for improving heat exchange efficiency.

Different from this, it is also possible that the duct 62 may be constructed to have a tube shape which surrounds the condensing unit 20. Of course, if a fan is provided to the condensing unit 20, heat exchange efficiency between the condensing unit 20 and the duct 62 can be improved further.

In the meantime, in the refrigerating cycle system in accordance with the first embodiment of the present invention, since the refrigerant passing through the duct 62 absorbs the heat from the refrigerant passing through the condensing unit 20, a temperature of the refrigerant passing through the condensing unit can be dropped. That is, since the refrigerant moving inside of the condensing unit 20 can be cooled, the operation efficiency of the refrigerating cycle system can be improved. That is, a condensing temperature of the condensing unit 20 can be dropped.

Figure 2:
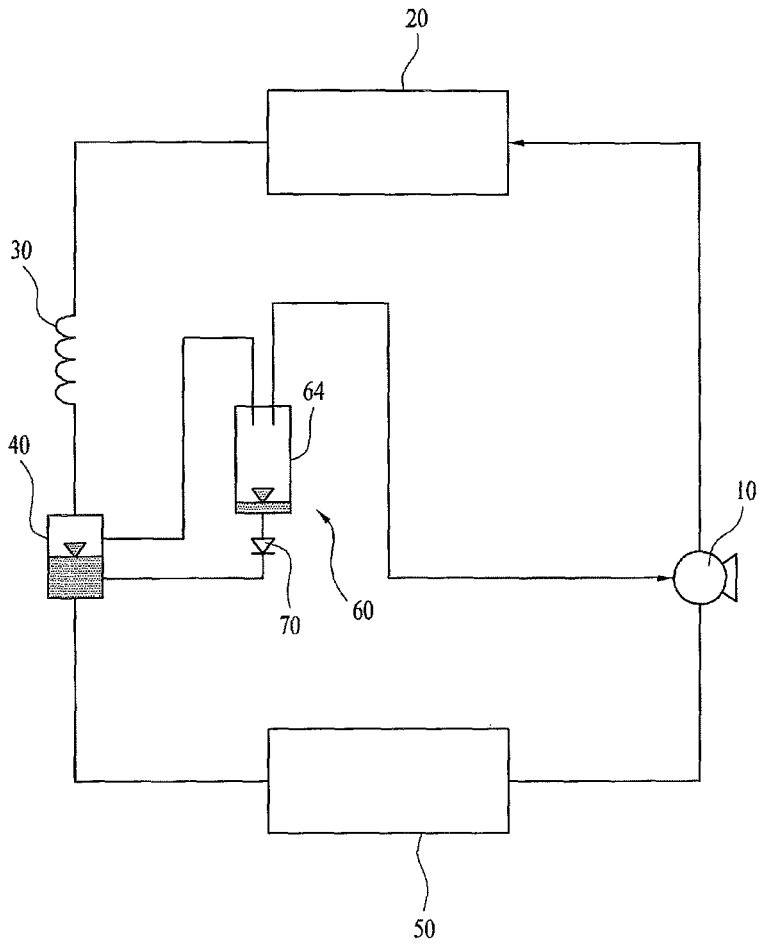
FIG. 2 illustrates a diagram showing a refrigerating cycle system in accordance with a second embodiment of the present invention.

FIG. 2 illustrates a diagram showing a refrigerating cycle system in accordance with a second embodiment of the present invention.

For convenience of description, the refrigerating cycle system in accordance with a second embodiment of the present invention will be described focused on a difference of the second embodiment from the first embodiment. Therefore, description of the first embodiment is applicable to the second embodiment.

In the second embodiment, the liquid refrigerant removal unit 60 can separate the refrigerant separated at the gas-liquid separating unit 40 into gas refrigerant and liquid refrigerant, additionally. In this arrangement, the liquid refrigerant removal unit 60 may include a housing 64 having a predetermined space.

The housing 64 may have an introduction pipe provided thereto for introduction of the refrigerant thereto from the gas-liquid separating unit 40. And, the housing 64 may have a gas refrigerant discharge pipe for discharging the gas refrigerant, and a liquid refrigerant discharge pipe for discharging the liquid refrigerant.

That is, the gas refrigerant separated at the liquid refrigerant removal unit 60 may be guided to the first compressor unit 10, and the liquid refrigerant separated at the liquid refrigerant removal unit 60 may be guided to the gas-liquid separating unit 40, again. As a result, the liquid refrigerant guided to the gas-liquid separating unit 40 may be guided to, and evaporated at, the first evaporator unit 50.

The liquid refrigerant discharge pipe may have a check valve 70 mounted thereto. The check valve 70 performs a function of allowing the liquid refrigerant to move in only one direction.

Therefore, since the check valve 70 can prevent the liquid refrigerant from the housing 64 from flowing in a reverse direction to the housing 64, reliability of a refrigerant flow in the refrigerating cycle system can be improved.

The housing 64 provides an additional effect that is different from a tube like pipe through which the liquid passes. In particular, since the housing 64 of the liquid refrigerant removal unit 60 has the predetermined space provided therein, the housing 64 can buffer the pressure change taking place when the gas refrigerant is passing therethrough. If the refrigerant is moving due to driving of the first compressor unit 10, a pressure of the gas refrigerant passed through the first capillary tube unit 30 is likely to vibrate within a predetermined range. And if the gas refrigerant having the pressure change is supplied to the first compressor unit 10, an overload is likely to occur at the first compressor unit 10. Therefore, since the housing 64 is arranged before the first compressor unit 10, with reference to a moving path of the gas refrigerant, the housing 64 is able to buffer the pressure change so that the first compressor unit 10 can have the gas refrigerant having a relatively low pressure change supplied thereto.

Figure 3:
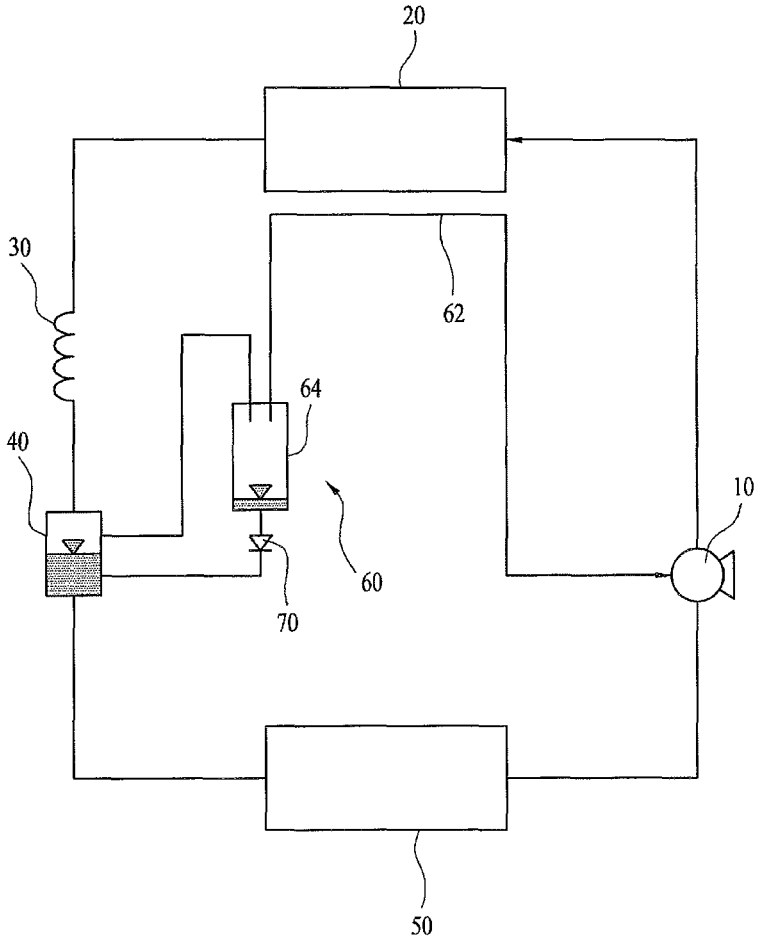
FIG. 3 illustrates a diagram showing a refrigerating cycle system in accordance with a third embodiment of the present invention.

FIG. 3 illustrates a diagram showing a refrigerating cycle system in accordance with a third embodiment of the present invention.

For convenience of description, the refrigerating cycle system in accordance with a third embodiment of the present invention will be described focused on differences of the third embodiment from the first embodiment and the second. Therefore, description of the first embodiment and the second is applicable to the third embodiment to be described hereafter.

The refrigerating cycle system in accordance with the third embodiment of the present invention has a mixed mode of the first embodiment and the second embodiment. That is, the refrigerating cycle system of the third embodiment includes a duct 62 provided adjacent to the condensing unit 20 and the housing 64 for separating the refrigerant from the gas-liquid separating unit 40 into the gas refrigerant and the liquid refrigerant again.

As such, the refrigerating cycle system of the third embodiment can further prevent supply of the liquid refrigerant to the first compressor unit 10.

In the meantime, the refrigerating cycle system of the third embodiment can provide not only a buffering effect on the pressure change owing to the housing 64, but also a cooling effect of the refrigerant passing through the condensing unit 20 due to the duct 62.

Figure 4A:
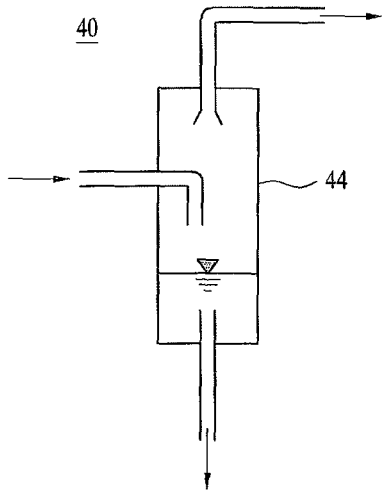
FIG. 4A illustrates a schematic view of a gas-liquid separating unit.
Figure 4B:
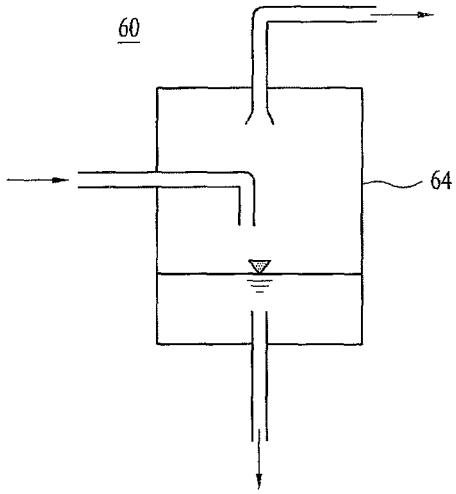
FIG. 4B illustrates a schematic view of a liquid refrigerant removal unit.

FIG. 4A illustrates a schematic view of the gas-liquid separating unit, and FIG. 4B illustrates a schematic view of the liquid refrigerant removal unit.

Referring to FIG. 4A, the gas-liquid separating unit 40 includes a case 44 having a space for separating the liquid refrigerant and the gas refrigerant from the refrigerant introduced thereto.

The case 44 has one side provided with a refrigerant introduction pipe for introduction of the refrigerant from the first capillary tube unit 30 thereto, a top side provided with a gas refrigerant discharge pipe, and a bottom side provided with a liquid refrigerant discharge pipe.

Referring to FIG. 4B, the liquid refrigerant removal unit 60 includes the housing 64 having an inside space, a refrigerant introduction pipe, a gas refrigerant discharge pipe, and a liquid refrigerant discharge pipe.

Referring to FIGS. 4A and 4B, it is preferable that a capacity of the inside space of the housing 64 is larger than a capacity of the inside space of the case 44. That is, the housing 64 may have an inside diameter larger than the inside diameter of the case 44 or the housing 64 has an overall length that is longer than an overall length of the case 44.

The gas-liquid separating unit 40, which separates the refrigerant passed through the first capillary tube unit 30 into the liquid refrigerant and the gas refrigerant, can have an effect of separating the liquid refrigerant and the gas refrigerant. This effect increases as the inside capacity increases. However, if the capacity of the case 44 becomes too large, thereby allowing heat exchange to take place within the case 44, unnecessary phase change of the liquid refrigerant into the gas refrigerant is likely to occur. Since such a phase change from the liquid refrigerant to the gas refrigerant causes leakage of cooling capability, a problem is likely to occur in which the operation efficiency of the refrigerating cycle system drops.

Therefore, it is preferable that the case 44 has a reduced capacity for preventing unnecessary heat exchange from taking place within the case 44.

In contrast to this problem for case 44, since the housing 64 is not a major refrigerant moving path of the refrigerating cycle system, accurate separation of the liquid refrigerant from the gas refrigerant is the more important aspect. Rather than taking the problem of heat exchange into account, the more important function may be preventing the liquid refrigerant from being introduced to the first compressor unit 10. Therefore, it is preferable that the efficiency of separating the liquid refrigerant and the gas refrigerant at the housing 64 is higher than the efficiency of separating the liquid refrigerant and the gas refrigerant at the case 44.

Figure 5:
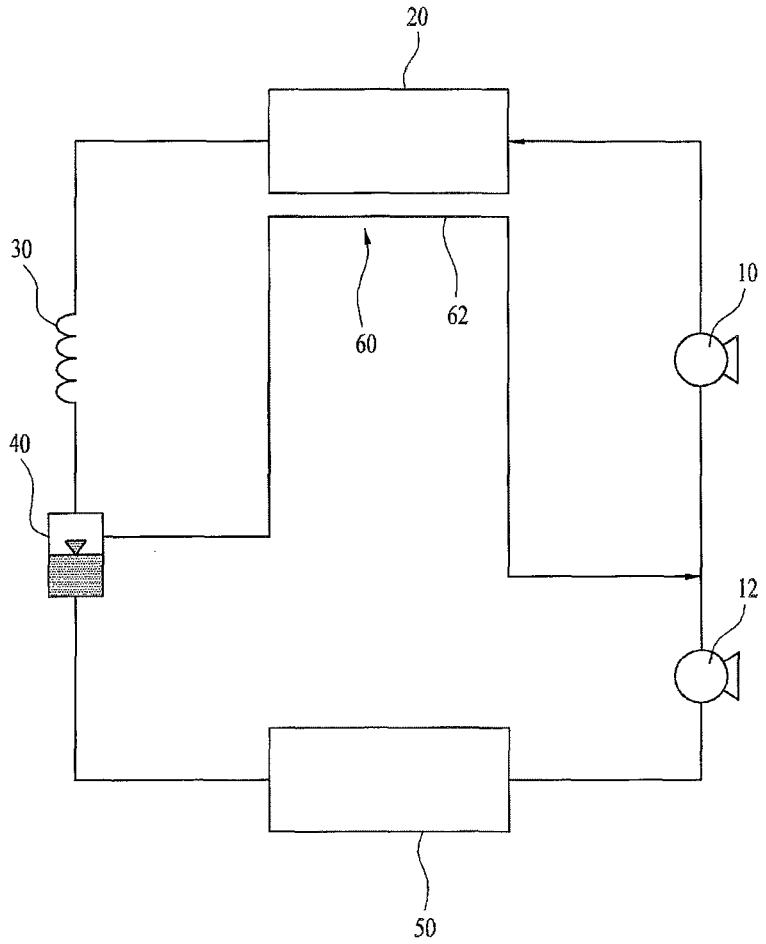
FIG. 5 illustrates a diagram showing a variation of the refrigerating cycle system in accordance with a first embodiment of the present invention.
Figure 6:
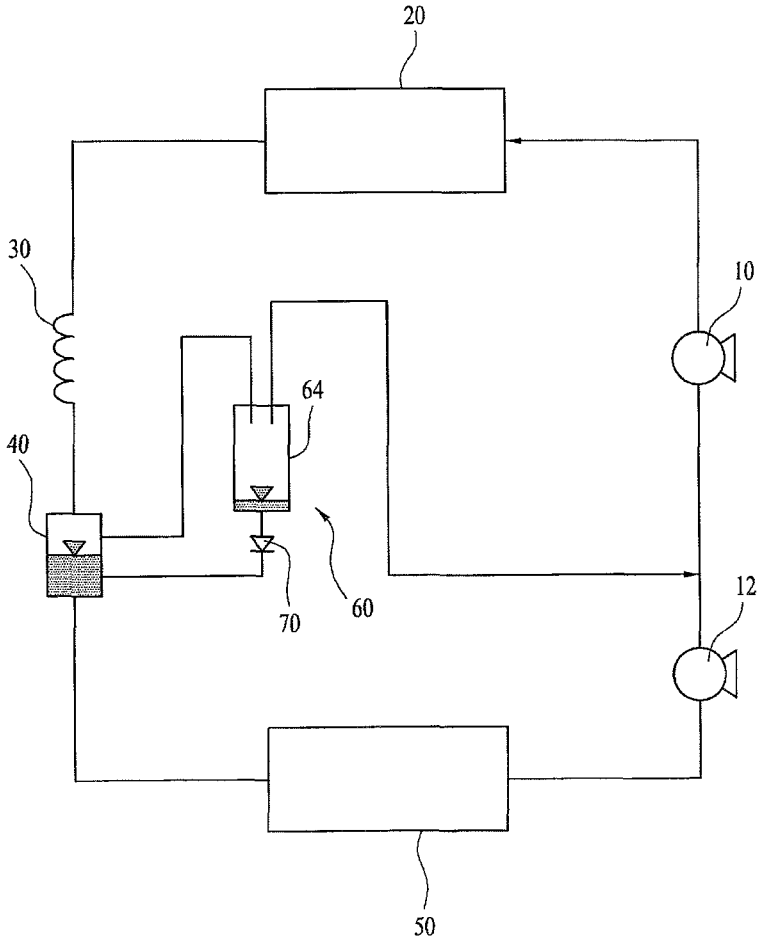
FIG. 6 illustrates a diagram showing a variation of the refrigerating cycle system in accordance with a second embodiment of the present invention.
Figure 7:
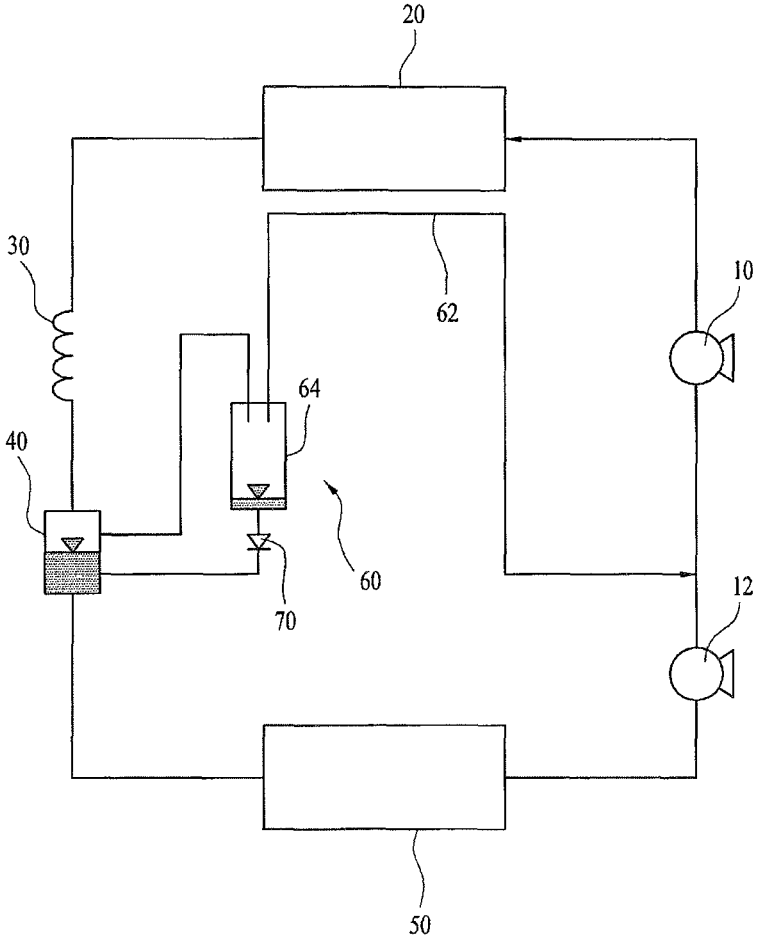
FIG. 7 illustrates a diagram showing a variation of the refrigerating cycle system in accordance with a third embodiment of the present invention.

FIG. 5 illustrates a diagram showing a variation of the refrigerating cycle system in accordance with a first embodiment of the present invention, FIG. 6 illustrates a diagram showing a variation of the refrigerating cycle system in accordance with a second embodiment of the present invention, and FIG. 7 illustrates a diagram showing a variation of the refrigerating cycle system in accordance with a third embodiment of the present invention. The variations of the refrigerating cycle systems in accordance with the first to third embodiments will be described with reference to FIGS. 5 to 7.

The variation of the refrigerating cycle systems in accordance with the first to third embodiments further included a second compressor unit 12 for compressing the refrigerant.

The second compressor unit 12 may have the gas refrigerant introduced thereto from the first evaporator unit 50 and compressed thereby.

In this arrangement, the first compressor unit 10 may have the refrigerant passed through the second compressor unit 12 and the refrigerant passed through the liquid refrigerant removal unit 60 guided thereto.

That is, the embodiments may suggest compression of the refrigerant with the first compressor unit 10 and the second compressor unit 12 step by step. The refrigerant is compressed by the second compressor 12 and guided to the first compressor unit 10 through a pipe. Since the refrigerant moves through the pipe, a temperature of the refrigerant may drop by heat exchange with an outside of the pipe. The refrigerant having the temperature dropped thus is compressed by the first compressor unit 10 again and guided to the condensing unit 20.

Since the temperature of the refrigerant can drop as the refrigerant passes between the first compressor unit 10 and the second compressor unit 12, whole operation efficiency of the refrigerating cycle system can be improved.

Figure 8:
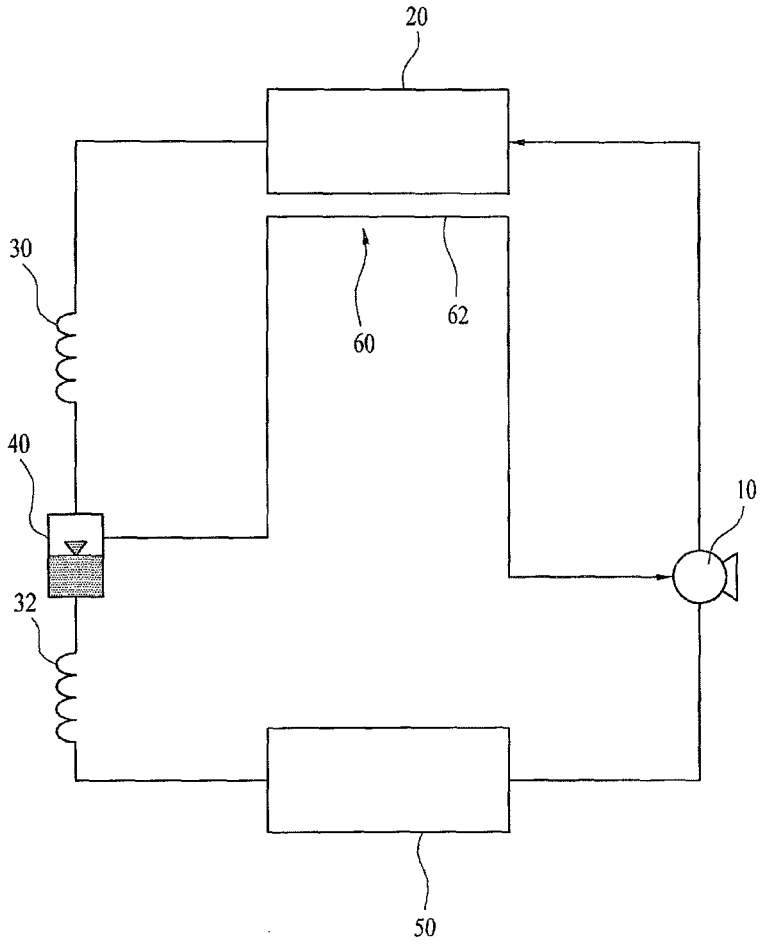
FIG. 8 illustrates a diagram showing another variation of the refrigerating cycle system in accordance with a first embodiment of the present invention.
Figure 9:
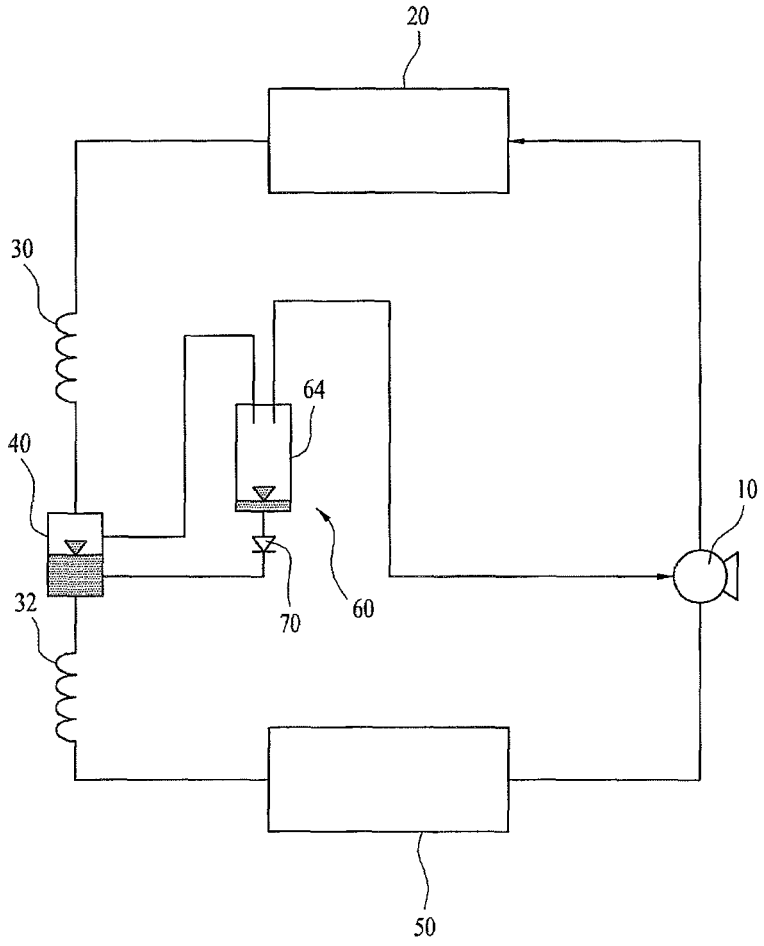
FIG. 9 illustrates a diagram showing another variation of the refrigerating cycle system in accordance with a second embodiment of the present invention.
Figure 10:
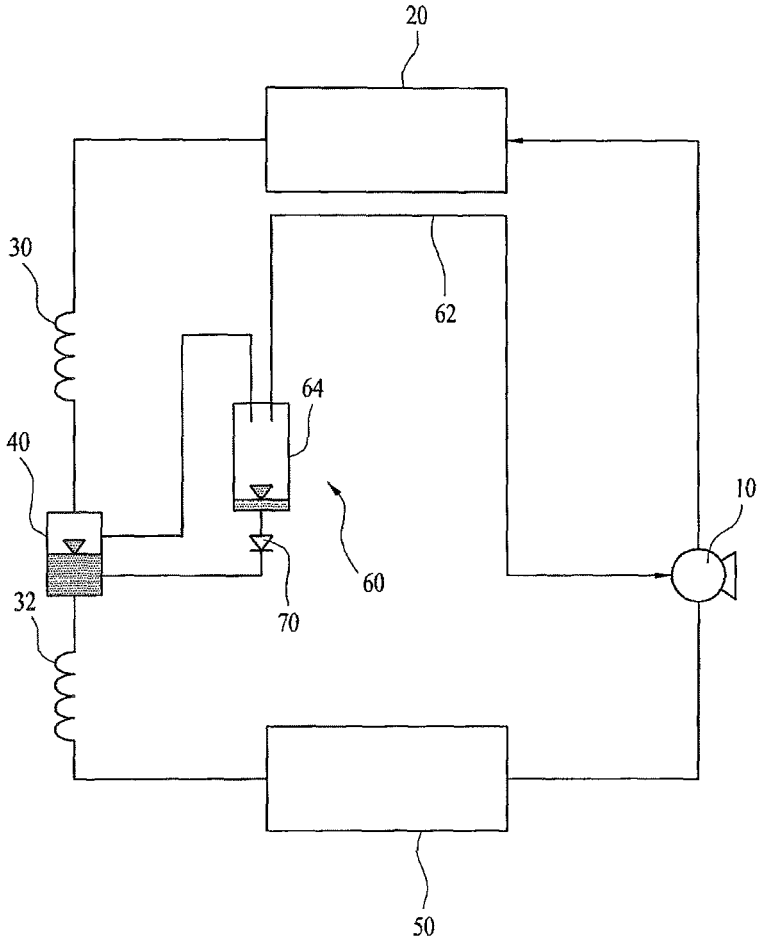
FIG. 10 illustrates a diagram showing another variation of the refrigerating cycle system in accordance with a third embodiment of the present invention.

FIG. 8 illustrates a diagram showing another variation of the refrigerating cycle system in accordance with a first embodiment of the present invention, FIG. 9 illustrates a diagram showing another variation of the refrigerating cycle system in accordance with a second embodiment of the present invention, and FIG. 10 illustrates a diagram showing another variation of the refrigerating cycle system in accordance with a third embodiment of the present invention.

Another variation of the refrigerating cycle systems in accordance with the first to third embodiments will be described with reference to FIGS. 8 to 10.

This variation of the refrigerating cycle systems in accordance with the first to third embodiments further includes a second capillary tube unit 32 for passing the liquid refrigerant separated at the gas-liquid separating unit 40 therethrough. The refrigerant passing through the second capillary tube unit 32 may be guided to the first evaporator unit 50.

That is, the embodiments may suggest passing the refrigerant through the second capillary tube unit 32 before the refrigerant is introduced to the first evaporator unit 50, to make the refrigerant to have easy heat exchange at the first evaporator unit 50, for improving the operation efficiency of a whole refrigerating cycle system.

Figure 11:
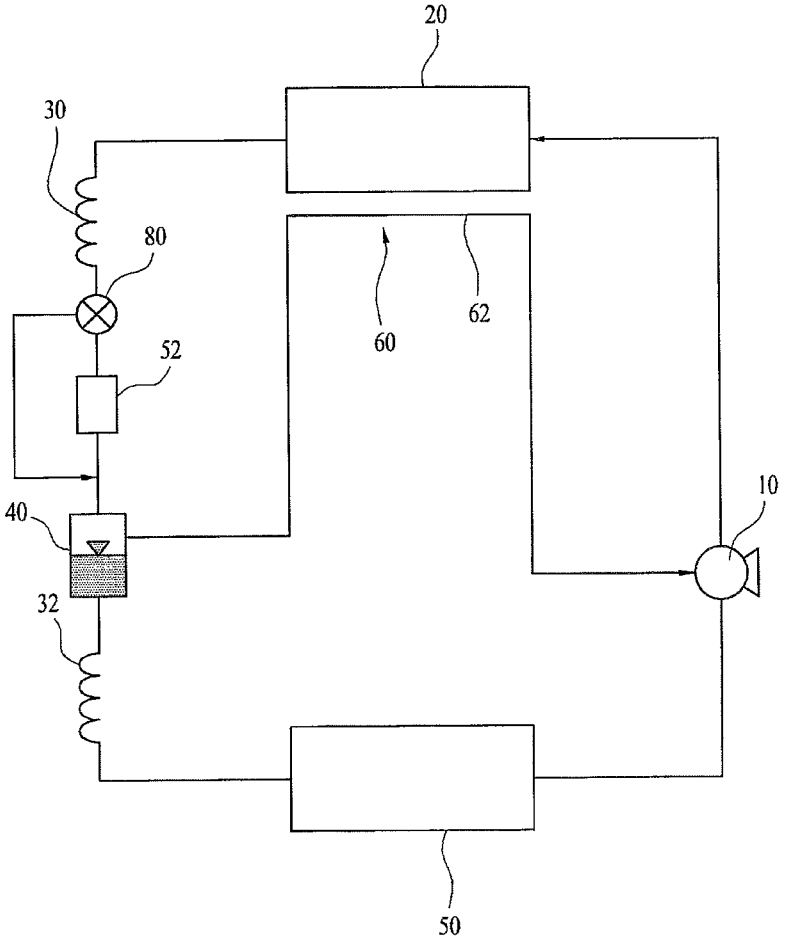
FIG. 11 illustrates a diagram showing still another variation of the refrigerating cycle system in accordance with a first embodiment of the present invention.
Figure 12:
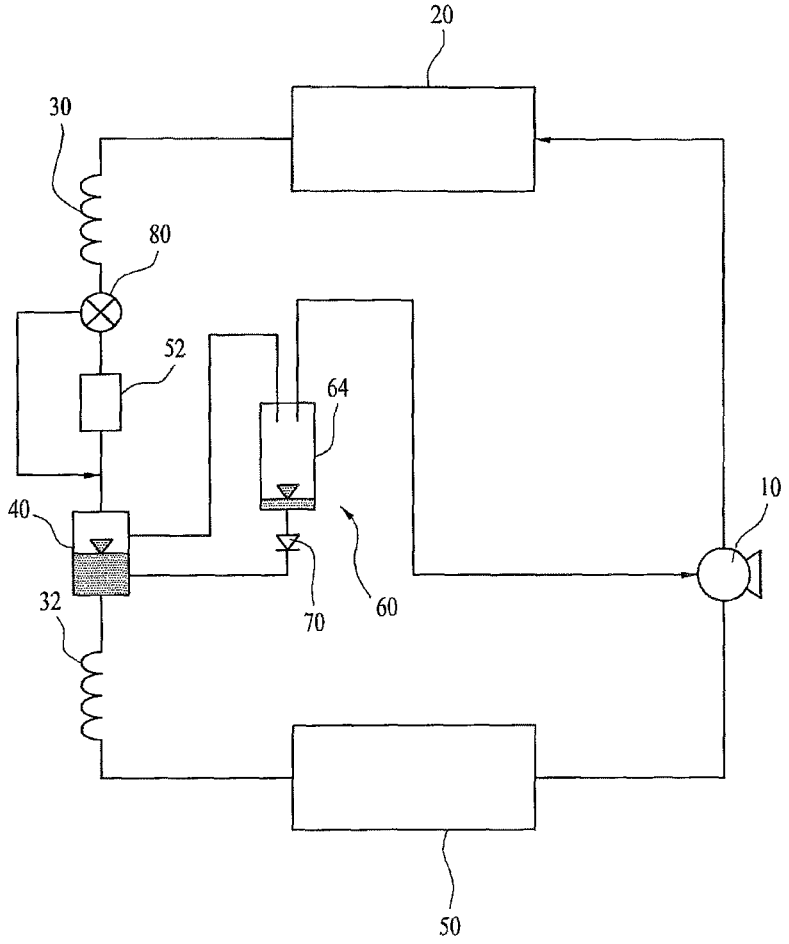
FIG. 12 illustrates a diagram showing still another variation of the refrigerating cycle system in accordance with a second embodiment of the present invention.
Figure 13:
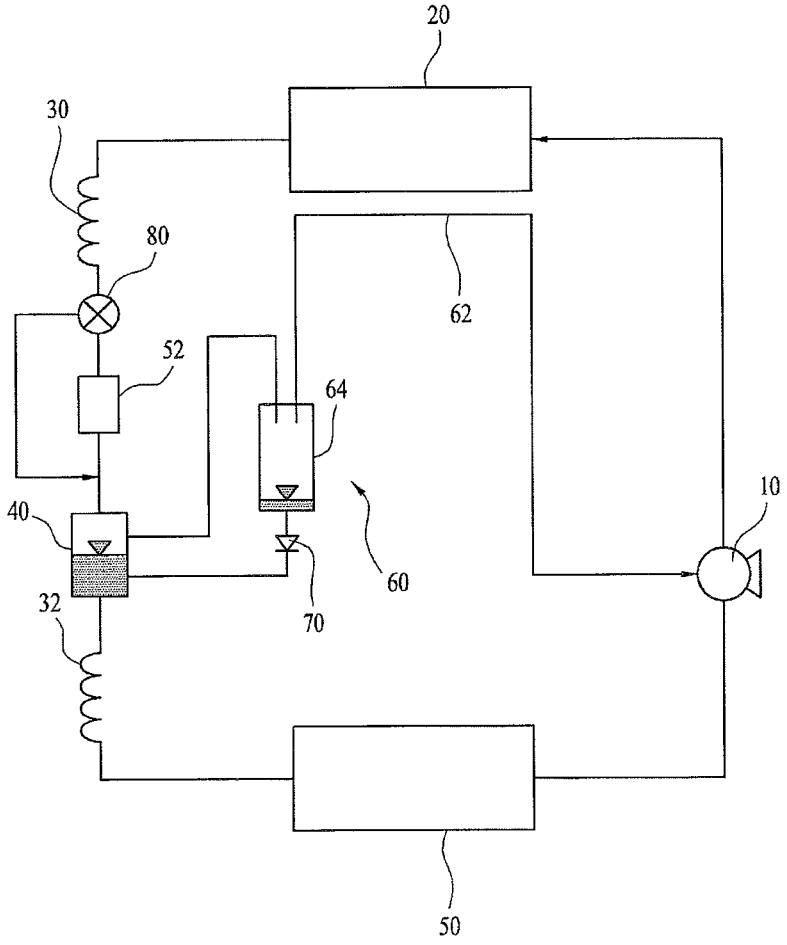
FIG. 13 illustrates a diagram showing still another variation of the refrigerating cycle system in accordance with a third embodiment of the present invention.

FIG. 11 illustrates a diagram showing still another variation of the refrigerating cycle system in accordance with a first embodiment of the present invention, FIG. 12 illustrates a diagram showing still another variation of the refrigerating cycle system in accordance with a second embodiment of the present invention, and FIG. 13 illustrates a diagram showing still another variation of the refrigerating cycle system in accordance with a third embodiment of the present invention.

The variation of the refrigerating cycle systems in accordance with the first to third embodiments will be described with reference to FIGS. 11 to 13, respectively.

The variation of the refrigerating cycle systems in accordance with the first to third embodiments further includes a second evaporator unit 52 for guiding the refrigerant passed through the first capillary tube 30 thereto.

In the meantime, it is possible to provide a flow passage control valve 80 between the first capillary tube unit 30 and the second evaporator unit 52 to allow the refrigerant to bypass the second evaporator unit 52 to control whether the refrigerant is supplied to the second evaporator unit 52 or to the gas-liquid separating unit 40 directly without making the refrigerant pass through the second evaporator unit 52.

The first evaporator unit 50 may be a freezing chamber evaporator unit for supplying cold to the freezing chamber, and the second evaporator unit 52 may be a refrigerating chamber evaporator for supplying the cold to the refrigerating chamber. That is, the first evaporator unit 50 and the second evaporator unit 52 may be sorted to supply the refrigerant to storage spaces different from each other.

For an example, if it is intended to supply the cold to the freezing chamber, the refrigerant may be made to bypass the flow passage control valve 80 for supplying no refrigerant to the second evaporator unit 52. That is, the refrigerant may be guided to the gas-liquid separating unit 40 through the flow passage control valve 80 after passing through the first compressor unit 10, the condensing unit 20, and the first capillary tube unit 30.

In contrast to above, if it is intended to supply the refrigerant to both the freezing chamber and the refrigerating chamber, the refrigerant may be supplied to the second evaporator unit 52 without bypassing the flow passage control valve 80. The refrigerant is guided to the second evaporator unit 52 through the flow passage control valve 80 after passing through the first compressor unit 10, the condensing unit 20, and the first capillary tube unit 30, and, therefrom to the gas-liquid separating unit 40.

In the meantime, if the refrigerant is supplied to the second evaporator 52, a large portion of the refrigerant can be phase changed from the liquid refrigerant to the gas refrigerant by heat exchange at the second evaporator unit 52. The gas refrigerant vaporized at the second evaporator unit 52 thus is guided to the liquid refrigerant removal unit 60 from the gas-liquid separating unit 40.

Therefore, a ratio of the liquid refrigerant to the refrigerant being supplied to the first evaporator unit 50 can be increased. That is, since the liquid refrigerant is introduced to the first evaporator unit 50, enabling to improve heat exchange efficiency of the first evaporator unit 50, the cold can be supplied to the freezing chamber, effectively.

Figure 14:
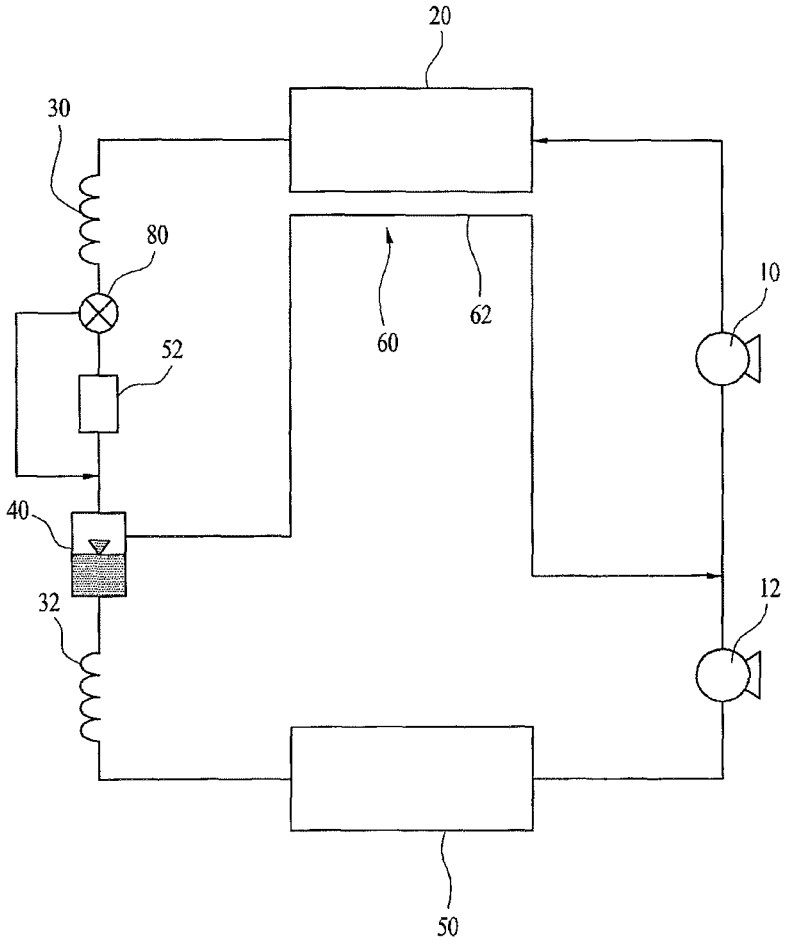
FIG. 14 illustrates a diagram showing a further variation of the refrigerating cycle system in accordance with a first embodiment of the present invention.
Figure 15:
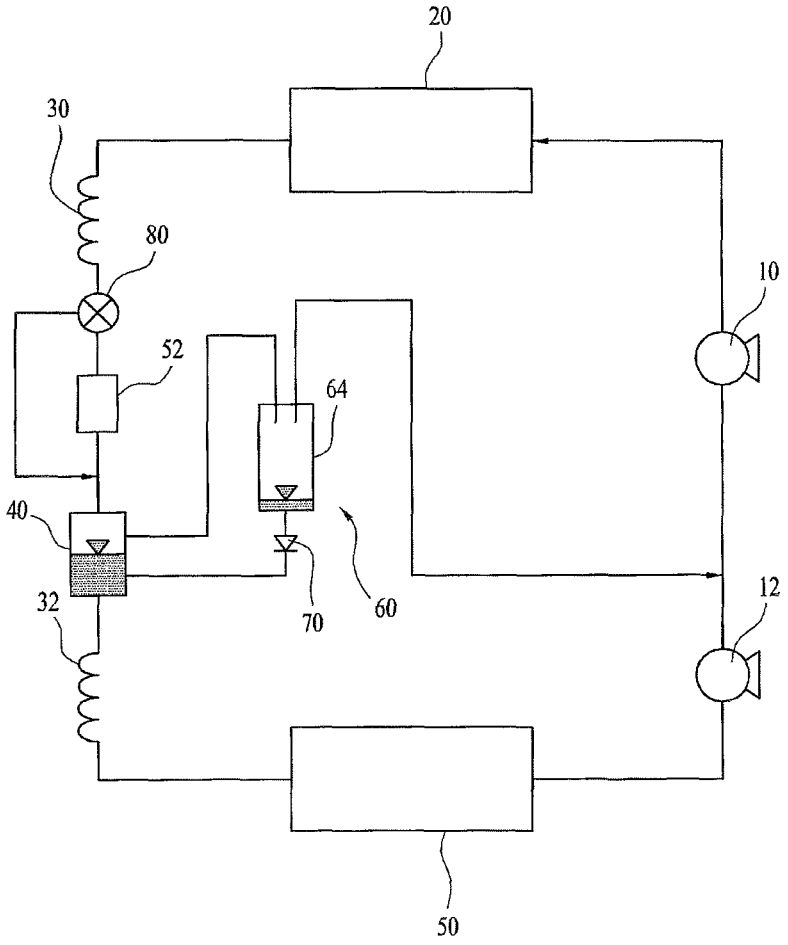
FIG. 15 illustrates a diagram showing a further variation of the refrigerating cycle system in accordance with a second embodiment of the present invention.
Figure 16:
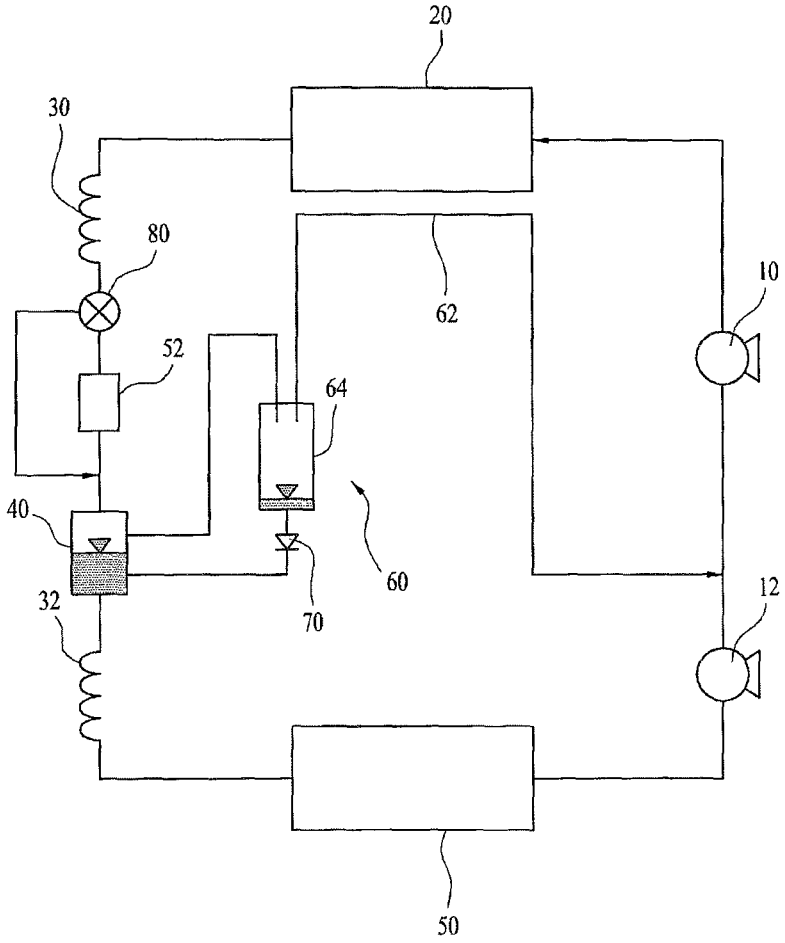
FIG. 16 illustrates a diagram showing a further variation of the refrigerating cycle system in accordance with a third embodiment of the present invention.

FIG. 14 illustrates a diagram showing a further variation of the refrigerating cycle system in accordance with a first embodiment of the present invention, FIG. 15 illustrates a diagram showing a further variation of the refrigerating cycle system in accordance with a second embodiment of the present invention, and FIG. 16 illustrates a diagram showing a further variation of the refrigerating cycle system in accordance with a third embodiment of the present invention.

Since this variation of the refrigerating cycle systems in accordance with the first to third embodiments further includes a second compressor unit 12, step by step compression of the refrigerant at the second compressor unit 12 and the first compressor unit 10 is possible. According to this, a load on the first compressor unit 10 can be reduced in comparison to a case the refrigerating cycle system is provided with only one compressor of the first compressor unit 10.

Figure 17:
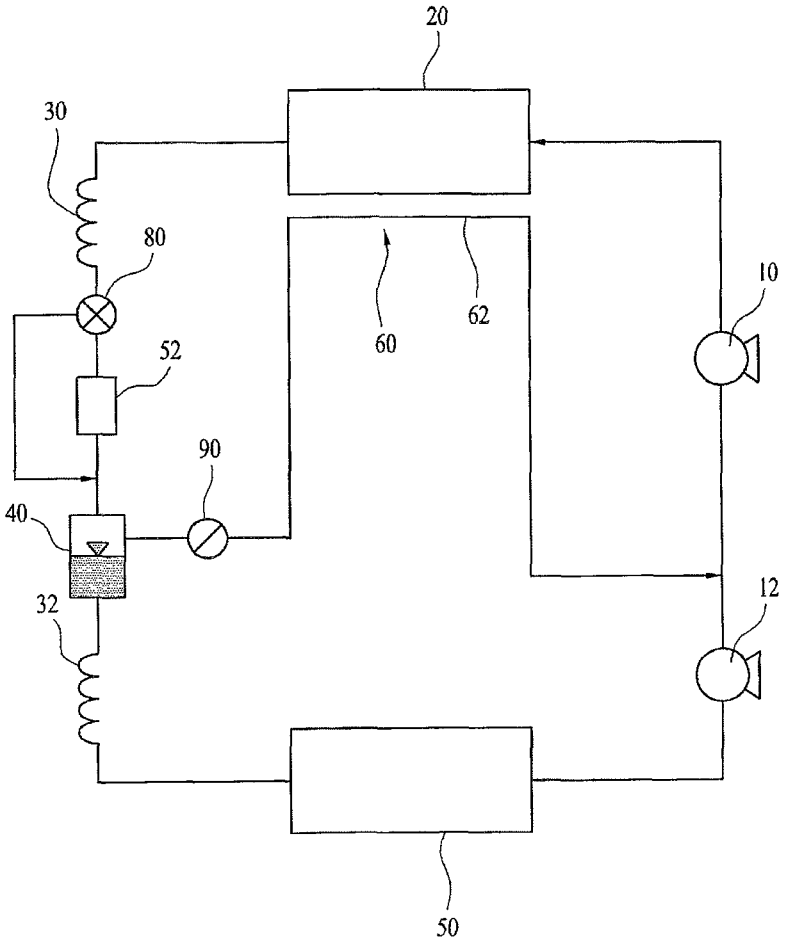
FIG. 17 illustrates a diagram showing a still further variation of the refrigerating cycle system in accordance with a first embodiment of the present invention.
Figure 18:
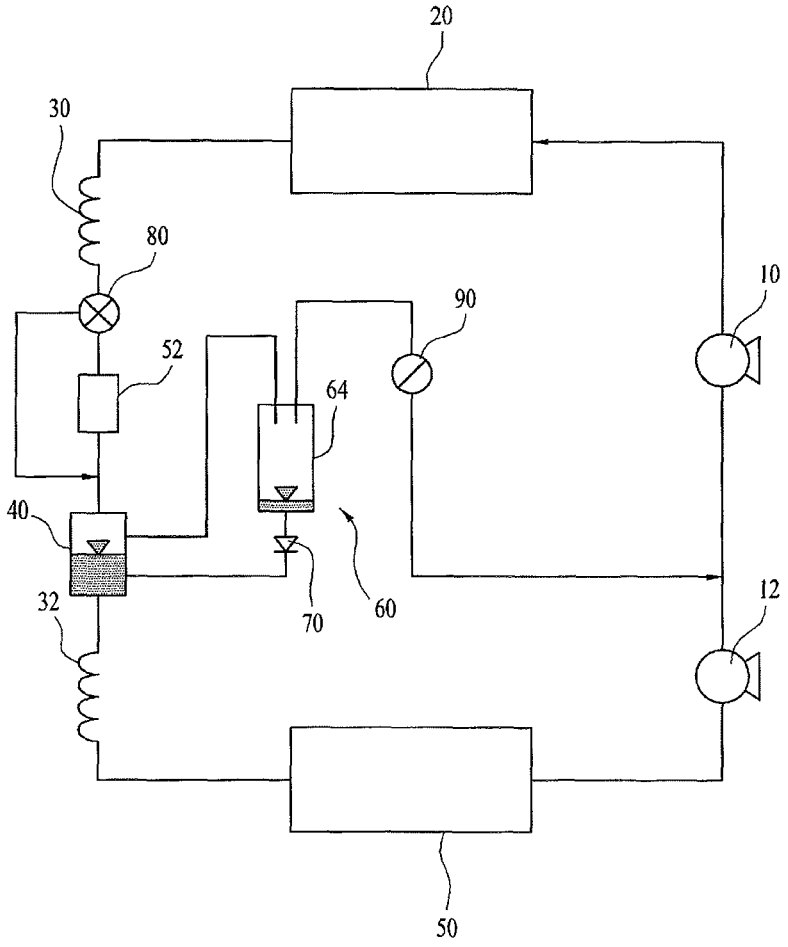
FIG. 18 illustrates a diagram showing a still further variation of the refrigerating cycle system in accordance with a second embodiment of the present invention.
Figure 19:
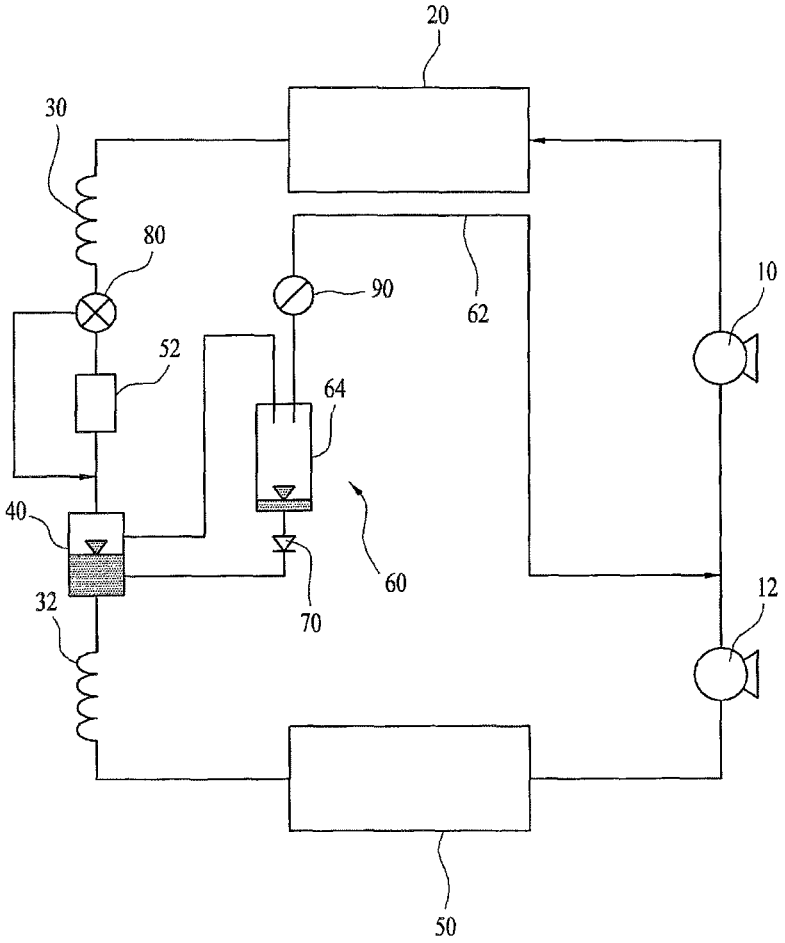
FIG. 19 illustrates a diagram showing a still further variation of the refrigerating cycle system in accordance with a third embodiment of the present invention.

FIG. 17 illustrates a diagram showing a still further variation of the refrigerating cycle system in accordance with a first embodiment of the present invention, FIG. 18 illustrates a diagram showing a still further variation of the refrigerating cycle system in accordance with a second embodiment of the present invention, and FIG. 19 illustrates a diagram showing a still further variation of the refrigerating cycle system in accordance with a third embodiment of the present invention.

This further variation of the refrigerating cycle systems in accordance with the first to third embodiments will be described with reference to FIGS. 17 to 19.

This further variation of the refrigerating cycle systems in accordance with the first to third embodiments further includes a valve 90 between the gas-liquid separating unit 40 and the first compressor unit 10 for controlling movement of the refrigerant.

Since the valve 90 can control a flow rate of the refrigerant moving from the gas-liquid separating unit 40 to the first compressor unit 10, the valve 90 can prevent the refrigerant from moving to the first compressor unit 10, excessively.

In the meantime, the refrigerating cycle systems in accordance with the first to third embodiments of the present invention are readily applicable to a general refrigerator.

Though not shown in the attached drawings in detail, the refrigerator of the present invention can include a first capillary tube unit 30 for guiding the refrigerant passed through the condensing unit 20 thereto, a gas-liquid separating unit 40 for separating the refrigerant passed through the first capillary tube unit 30 into liquid refrigerant and gas refrigerant, a first evaporator unit 50 for guiding the liquid refrigerant separated at the gas-liquid separating unit 40 thereto, a liquid refrigerant removal unit 60 for guiding the gas refrigerant separated at the gas-liquid separating unit thereto, and a first compressor unit 10 for introducing the gas refrigerant guided from the liquid refrigerant removal unit 60 thereto.

The liquid refrigerant removal unit 60 can prevent supply of the liquid refrigerant to the first compressor unit 10.

As has been described, the refrigerating cycle system and the refrigerator having the same of the present invention have the following advantages.

Operation efficiency of the refrigerating cycle system and the refrigerator having the same can be improved, thereby increasing energy efficiency.

A flow rate of the liquid refrigerant to the compressor can be reduced.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A refrigerating cycle system comprising:

a condenser;

a first capillary tube configured to receive a refrigerant that has passed through the condenser;

a gas-liquid separator configured to separate the refrigerant that has passed through the first capillary tube into liquid refrigerant and gaseous refrigerant;

a first evaporator configured to receive the liquid refrigerant separated at the gas-liquid separator;

a liquid refrigerant remover configured to receive the gaseous refrigerant separated at the gas-liquid separator; and a first compressor configured to receive the gaseous refrigerant from the liquid refrigerant remover, wherein the liquid refrigerant remover includes:

a housing configured to separate liquid refrigerant included in the gaseous refrigerant separated at the gas-liquid separator; and a duct connected from the housing to the first compressor and arranged to enable heat exchange with the condenser, so that liquid refrigerant in the duct undergoes a phase change to a gaseous refrigerant upon reception of heat from the condenser, and wherein the housing comprises:

an introduction pipe that introduces the gaseous refrigerant from the gas-liquid separator;

a gaseous refrigerant discharge pipe that discharges the gaseous refrigerant into the duct; and a liquid refrigerant discharge pipe that discharges the liquid refrigerant to the gas-liquid separator.

2. The refrigerating cycle system as claimed in claim 1, wherein the liquid refrigerant remover is configured to reduce a flow rate of liquid refrigerant moving together with the gaseous refrigerant separated at the gas-liquid separator.

3. The refrigerating cycle system as claimed in claim 1, wherein the liquid refrigerant remover is configured to increase a ratio of the gaseous refrigerant separated at the gas-liquid separator.

4. The refrigerating cycle system as claimed in claim 1, wherein the liquid refrigerant remover is configured to increase a flow rate of the gaseous refrigerant separated at the gas-liquid separator.

5. The refrigerating cycle system as claimed in claim 1, wherein the duct is arranged adjacent to the condenser.

6. The refrigerating cycle system as claimed in claim 1, wherein the gaseous refrigerant separated at the liquid refrigerant remover is guided to the first compressor and the liquid refrigerant separated at the liquid refrigerant remover is guided to the gas-liquid separator.

7. The refrigerating cycle system as claimed in claim 1, wherein the gas-liquid separator has a capacity smaller than a capacity of the liquid refrigerant remover.

8. The refrigerating cycle system as claimed in claim 1, wherein the liquid refrigerant remover is configured to buffer a pressure change of the gaseous refrigerant separated at the gas-liquid separator caused by movement of the gaseous refrigerant.

9. The refrigerating cycle system as claimed in claim 1, further comprising a second compressor configured to guide the refrigerant that has passed through the first evaporator to the first compressor such that the first compressor receives the refrigerant that has passed through the second compressor and the gaseous refrigerant that has passed through the liquid refrigerant remover.

10. The refrigerating cycle system as claimed in claim 1, further comprising a second capillary tube in communication with the gas-liquid separator and the first evaporator.

11. The refrigerating cycle system as claimed in claim 10, further comprising a second evaporator in communication with the first capillary tube and the gas-liquid separator.

12. The refrigerating cycle system as claimed in claim 1, further comprising a valve located between the gas-liquid separator and the first compressor.

13. The refrigerator as claimed in claim 1, wherein the liquid refrigerant discharge pipe has a check valve that allows the liquid refrigerant to flow into the gas-liquid separator in only one direction.

14. A refrigerator having a refrigerating cycle system, the refrigerator comprising:

a condenser;

a first capillary tube configured to receive a refrigerant that has passed through the condenser;

a gas-liquid separator configured to separate the refrigerant that has passed through the first capillary tube into liquid refrigerant and gaseous refrigerant;

a first evaporator configured to receive the liquid refrigerant separated at the gas-liquid separator;

a liquid refrigerant remover configured to receive the gaseous refrigerant separated at the gas-liquid separator; and a first compressor configured to receive the gaseous refrigerant from the liquid refrigerant remover, wherein the liquid refrigerant remover includes:

a housing configured to separate liquid refrigerant included in the gaseous refrigerant separated at the gas-liquid separator; and a duct connected from the housing to the first compressor and arranged to enable heat exchange with the condenser, so that liquid refrigerant in the duct undergoes a phase change to a gaseous refrigerant upon reception of heat from the condenser, and wherein the housing comprises:

an introduction pipe that introduces the gaseous refrigerant from the gas-liquid separator;

a gaseous refrigerant discharge pipe that discharges the gaseous refrigerant into the duct; and a liquid refrigerant discharge pipe that discharges the liquid refrigerant to the gas-liquid separator.

15. The refrigerator as claimed in claim 14, wherein the gas-liquid separator has a capacity smaller than a capacity of the liquid refrigerant remover.

16. The refrigerator as claimed in claim 14, wherein the liquid refrigerant remover is arranged adjacent to the condenser.

* * * * *